US012331980B2

(12) United States Patent
Enoki et al.

(10) Patent No.: US 12,331,980 B2
(45) Date of Patent: Jun. 17, 2025

(54) SNOW MAKING APPARATUS AND ENVIRONMENT FORMING APPARATUS

(71) Applicant: ESPEC CORP., Osaka (JP)

(72) Inventors: Hiroyuki Enoki, Osaka (JP); Koshi Tamura, Osaka (JP); Kouki Sakane, Osaka (JP)

(73) Assignee: ESPEC CORP., Osaka (JP)

( * ) Notice: Subject to any disclaimer, the term of this patent is extended or adjusted under 35 U.S.C. 154(b) by 601 days.

(21) Appl. No.: 17/478,275

(22) Filed: Sep. 17, 2021

(65) Prior Publication Data

US 2022/0090837 A1 Mar. 24, 2022

(30) Foreign Application Priority Data

Sep. 23, 2020 (JP) ..... 2020-158577
Aug. 6, 2021 (JP) ..... 2021-129625

(51) Int. Cl.
*F25C 3/00* (2006.01)

(52) U.S. Cl.
CPC ..... *F25C 3/00* (2013.01); *F25C 2303/044* (2013.01); *F25C 2303/0481* (2013.01)

(58) Field of Classification Search
CPC ..... F25C 2303/044; F25C 2303/0481; F25C 3/00; F25C 3/04; F25C 3/048; A01G 15/00; B05B 7/0483; B05B 7/0475
USPC ..... 239/14.2
See application file for complete search history.

(56) References Cited

U.S. PATENT DOCUMENTS 4,809,514 A * 3/1989 Suga ..... F25D 21/06 239/14.2

FOREIGN PATENT DOCUMENTS

| | | | | |
|---|---|---|---|---|
| CN | 107314587 A | | 11/2017 | |
| CN | 108168173 A | | 6/2018 | |
| CN | 211204540 U | | 8/2020 | |
| JP | S63-140269 A | | 6/1988 | |
| JP | H02-136662 A | | 5/1990 | |
| JP | H03-001063 A | | 1/1991 | |
| JP | H031063 | * | 1/1991 | ..... F25C 3/04 |

(Continued)

OTHER PUBLICATIONS

An Office Action mailed by China National Intellectual Property Administration on Aug. 10, 2023, which corresponds to Chinese Patent Application No. 202111110158.0 and is related to U.S. Appl. No. 17/478,275; with English summary.

(Continued)

*Primary Examiner* — Christopher R Dandridge

(74) *Attorney, Agent, or Firm* — Studebaker Brackett PLLC

(57) ABSTRACT

A snow making apparatus includes a cylindrical body and a snow making nozzle that jets water droplets into the cylindrical body. The cylindrical body has a proximal end that is opened to a temperature environment where snow can be produced from water droplets jetted from the snow making nozzle. A distal end of the cylindrical body is connected to a pipe member communicating with a test chamber. The snow making nozzle is formed of a two-fluid nozzle. The pipe member communicates with a snowfall hood disposed in the test chamber and having a supply opening that allows snow to fall. The cylindrical body is disposed in an oblique posture so as to be lowered from a proximal end toward a distal end of the cylindrical body.

17 Claims, 16 Drawing Sheets

(56) References Cited

FOREIGN PATENT DOCUMENTS

| | | | | | |
|---|---|---|---|---|---|
| JP | H06-34245 | A | | 2/1994 | |
| JP | H08327202 | | * | 12/1996 | ..... F25C 3/04 |
| JP | H0972643 | | * | 3/1997 | ..... F25C 3/04 |
| JP | 2001004257 | | * | 1/2001 | ..... F25C 3/04 |
| JP | 2014-055755 | A | | 3/2014 | |
| JP | 2016-006362 | A | | 1/2016 | |
| JP | 2018-036069 | A | | 3/2018 | |

OTHER PUBLICATIONS

An Office Action; "Notice of Reasons for Refusal," mailed by the Japanese Patent Office on Jul. 25, 2023, which corresponds to Japanese Patent Application No. 2021-129625 and is related to U.S. Appl. No. 17/478,275; with English language translation.

An Office Action; "Notice of Reasons for Refusal," mailed by the Japanese Patent Office on May 7, 2024, which corresponds to Japanese Patent Application No. 2023-194322 and is related to U.S. Appl. No. 17/478,275; with English language translation.

* cited by examiner

SNOW MAKING APPARATUS AND ENVIRONMENT FORMING APPARATUS

TECHNICAL FIELD

The present invention relates to a snow making apparatus and an environment forming apparatus.

BACKGROUND ART

Conventionally, as disclosed in JP 2018-036069A, there has been known a snow making apparatus which can produce a snowfall in a test chamber by supplying air cooled to about minus 20 to minus 40 degrees Celsius. The snow making apparatus disclosed in JP 2018-036069A includes a spray nozzle disposed on a ceiling portion of the test chamber, and a snowfall is produced in the test chamber when water droplets are jetted from the spray nozzle into the test chamber.

As in the case of the snow making apparatus disclosed in JP 2018-036069A, in order to produce snowflakes from water droplets jetted from the spray nozzle, it is necessary to jet extremely fine water droplets from the injection nozzle. As a result, snowflakes produced in this manner contains a certain amount of extremely fine snowflakes. Accordingly, snowflakes which are produced from water droplets jetted downward from the ceiling portion contain a certain amount of snowflakes which do not flow toward a test piece and keep floating in the air. Since such snowflakes float in the test chamber, such snowflakes are not supplied to the test piece. Under such circumstances, in order to make a predetermined amount of snowfall on the test piece, it is necessary to produce an amount of snow larger than the predetermined amount of snow. Such production of extra snow leads to an increase in running cost.

SUMMARY OF THE INVENTION

It is an object of the present invention to provide a snow making apparatus capable of suppressing a running cost.

According to one aspect of the present invention, there is provided a snow making apparatus which includes: a cylindrical body; and a snow making nozzle configured to jet water droplets into the cylindrical body. The cylindrical body has a proximal end which is opened to a temperature environment where snow can be produced from water droplets jetted from the snow making nozzle. A distal end of the cylindrical body is opened so that air flows toward a test piece or a test chamber, or is connected to a pipe member which opens so that the air flows toward the test piece, or is connected to a pipe member which is connected to the test chamber.

According to another aspect of the present invention, there is provided an environment forming apparatus which includes the snow making apparatus.

DESCRIPTION OF EMBODIMENTS

Hereinafter, exemplary embodiments are described in detail with reference to drawings.

First Exemplary Embodiment

Figure 1:
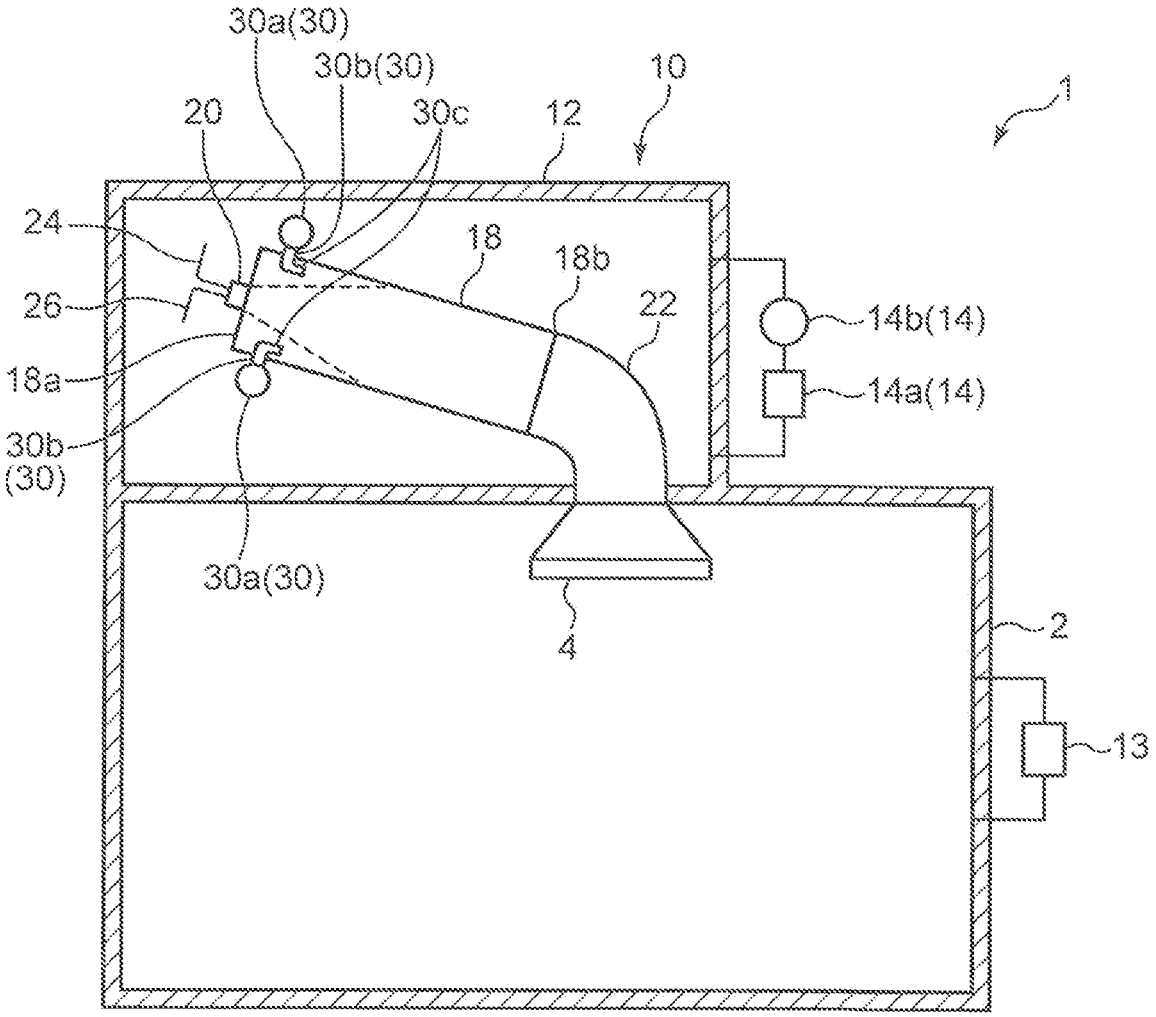
FIG. 1 is a view schematically illustrating a snowfall environment test apparatus to which a snow making apparatus according to a first exemplary embodiment is applied.

FIG. 1 schematically illustrates a snowfall environment test apparatus 1 (environment forming apparatus) to which a snow making apparatus 10 according to a first exemplary embodiment is applied. The snowfall environment test apparatus 1 includes a test chamber 2 that provides a snowfall environment. A test piece is placed in the test chamber 2. The snowfall environment may be a temperature environment where snow can be produced from water droplets. However, the snowfall environment may be a temperature environment where a temperature is higher than a temperature of the above-mentioned temperature environment. That is, the temperature environment may be a temperature environment at a temperature where although snow is not easily produced from water droplets, melting of snow hardly occurs. For example, the environment may be a temperature environment at a temperature which reproduces a temperature environment in a cold district. Specifically, the temperature environment may be a temperature environment at a temperature of about +5° C. to −10° C. To provide such a temperature environment, the test chamber 2 may include an air conditioner 13 for adjusting a temperature of air in the test chamber 2.

On a ceiling portion of the test chamber 2, a snowfall hood 4 in which a supply opening is formed is disposed to make snowfalls into the test chamber 2 through the supply opening. Air containing snow is supplied from the snow making apparatus 10 to the snowfall hood 4, and the snowfall hood 4 allows snow to fall into the test chamber 2.

The snow making apparatus 10 is a device for producing snow from fine water droplets. The snow making apparatus 10 includes a snow making chamber 12 that provides a temperature environment at a temperature lower than a temperature in the test chamber 2. The snow making chamber 12 is a chamber that provides a temperature environment where snow can be produced from fine water droplets. The inside of the snow making chamber 12 is adjusted to, for example, a temperature environment at a temperature of about −15° C. to −25° C. To provide such a temperature environment, the snow making chamber 12 is provided with: an air conditioner 14 including a cooler 14*a* for cooling air in the snow making chamber 12; and a blower 14*b* for blowing off the air cooled by the cooler 14*a* into the snow making chamber 12.

The snow making apparatus 10 includes: a cylindrical body 18; a snow making nozzle 20 for jetting water droplets into the cylindrical body 18; and a pipe member 22 connected to the cylindrical body 18.

The cylindrical body 18 is formed of a member which is formed in a cylindrical shape extending in a straight line in one direction. A proximal end (one end) 18*a* and a distal end (the other end) 18*b* of the cylindrical body 18 are opened. The proximal end 18*a* is opened to the snow making chamber 12. With such a configuration, a temperature environment of a space in the cylindrical body 18 becomes the same as the temperature environment in the snow making chamber 12. Accordingly, the water droplets jetted from the snow making nozzle 20 turn into snowflakes in the cylindrical body 18 during flowing from the proximal end 18*a* toward the distal end 18*b*. That is, snow can be produced in the cylindrical body 18.

In the illustrated example, the cylindrical body 18 has a shape extending in a straight line. However, the shape of the cylindrical body 18 is not limited to such a shape, and the cylindrical body 18 may have a curved bent shape. However, to take into account the sticking of snow to an inner surface of the cylindrical body 18, it is preferable that the cylindrical body 18 have a shape extending in a straight line. The cylindrical body 18 is made of metal or resin so that the cylindrical body 18 does not change in shape. However, the cylindrical body 18 may be formed using a flexible material. In this case, the cylindrical body 18 can be bent in conformity with an environment where the cylindrical body 18 is disposed or the like. Accordingly, the cylindrical body 18 is minimally affected by the environment where the cylindrical body 18 is disposed.

The cylindrical body 18 may be extensible and contractible. In this case, the snow making nozzle 20 may be movable corresponding to extension or contraction of the cylindrical body 18. When the cylindrical body 18 is configured to be extensible and contractible, a quality (water content) of snow flowing out from the cylindrical body 18 changes corresponding to a length of the cylindrical body 18. Even when the cylindrical body 18 is not configured to be extensible and contractible, the snow making nozzle 20 may be configured to be movable.

Surface treatment such as fluororesin coating may be applied to an inner surface of the cylindrical body 18 so as to make snow hardly stick to the inner surface of the cylindrical body 18.

The cylindrical body 18 is disposed in the snow making chamber 12 in an inclined state such that the proximal end 18*a* is disposed at a position higher than a position where the distal end 18*b* is disposed. It is not always necessary that the cylindrical body 18 is disposed in an inclined state. The cylindrical body 18 may be disposed in a posture where the cylindrical body 18 extends in a horizontal direction or in a posture where the cylindrical body 18 extends in a vertical direction.

The snow making nozzle 20 is disposed corresponding to the position of the proximal end 18*a* of the cylindrical body 18. The snow making nozzle 20 is formed of a two-fluid nozzle, and is configured to jet air and fine water droplets. That is, an air supply path 24 and a cold water supply path 26 are connected to the snow making nozzle 20. The snow making nozzle 20 jets compressed air (or cooled compressed air) supplied through the air supply path 24 and cold water supplied through the cold water supply path 26 from a jetting opening. At the jetting opening, compressed air and cold water collide with each other so that cold water is crushed. Therefore, a fluid in a state where air and fine water droplets are mixed is jetted from the jetting opening. Since the jetting opening is squeezed, a fluid jetted from the jetting opening gradually expands. Since air is jetted from the snow making nozzle 20, because of an action of jetted air, air in the snow making chamber 12 enters the cylindrical body 18 from the proximal end 18*a*, and an air flow is generated in the cylindrical body 18 by an action of jetted air.

Since the snow making nozzle 20 is disposed in a posture where the jetting opening faces the inside of the cylindrical body 18, a fluid in a state where air and fine water droplets are mixed is jetted into the cylindrical body 18. The snow making nozzle 20 of the illustrated example is arranged corresponding to the position of the proximal end 18*a* of the cylindrical body 18. However, the arrangement of the snow making nozzle 20 is not limited to such an arrangement. The snow making nozzle 20 may be disposed at a position adjacent to the proximal end 18*a*. For example, the snow making nozzle 20 may jet a fluid into the cylindrical body 18 in a state where the snow making nozzle 20 is disposed at a position displaced from the proximal end 18*a* in a direction away from the cylindrical body 18. In this case, the position of the snow making nozzle 20 may be set within a range that the whole mixed fluid of jetted water droplets and jetted air flows into the cylindrical body 18. The snow making nozzle 20 may be disposed in the cylindrical body 18. In this case, the snow making nozzle 20 is disposed in a posture where the jetting opening faces the distal end 18*b*. However, the larger a distance by which the snow making nozzle 20 is away from the proximal end 18*a*, the shorter a portion of the cylindrical body 18 which functions as a duct in the cylindrical body 18 becomes. Accordingly, it is preferable that the snow making nozzle 20 be not too away from the proximal end 18*a*.

The pipe member 22 is connected to the distal end 18*b* of the cylindrical body 18 and is connected to the snowfall hood 4. That is, the pipe member 22 communicates with the test chamber 2. The pipe member 22 guides air containing snow flown out of the cylindrical body 18 into the snowfall hood 4. Since the cylindrical body 18 is disposed in an inclined posture and the snowfall hood 4 is disposed below the cylindrical body 18, the pipe member 22 is formed in a shape where the pipe member 22 is bent toward an inlet of the snowfall hood 4.

The snow making apparatus 10 includes a snow sticking suppressing means (snow sticking suppressing unit) 30 for suppressing snow from sticking to an inner surface of the cylindrical body 18. The snow sticking suppressing means 30 includes blowers 30*a* that allow air to flow along an inner surface of the cylindrical body 18. The blowers 30*a* are disposed outside the cylindrical body 18 in the vicinity of the proximal end 18*a* of the cylindrical body 18. A blowout pipe 30*b* having an outflow end opened inside the cylindrical body 18 is connected to each blower 30*a*. Each blowout pipe 30*b* penetrates the cylindrical body 18 and has an extending portion 30*c* extending in a direction toward the distal end 18*b* along the inner surface of the cylindrical body 18. An outflow end of the blowout pipe 30*b* (distal end of the extending portion 30*c*) opens toward the distal end 18*b* of the cylindrical body 18 in the cylindrical body 18. With such a configuration, air fed out from the blower 30*a* is blown from an outflow end of the blowout pipe 30*b* and flows toward the distal end 18*b* of the cylindrical body 18 along the inner surface of the cylindrical body 18. As a result, it is possible to suppress snow produced from water droplets from sticking to the inner surface of the cylindrical body 18. The blowout pipes 30*b* are disposed in the cylindrical body 18 at positions where water droplets jetted from the snow making nozzle 20 do not stick to the blowout pipes 30*b*. In a case where the sticking (depositing) of snow to the cylindrical body 18 does not cause a problem such as a case where a test time is short, the snow sticking suppressing means 30 can be omitted.

A plurality of blowers 30*a* and a plurality of blowout pipes 30*b* are provided, and these blowers 30*a* and blowout pipes 30*b* are disposed at intervals in the circumferential direction of the cylindrical body 18. Only one blower 30*a* and only one blowout pipe 30*b* may be provided to one cylindrical body 18.

The blower 30*a* may suck and blow out air in the snow making chamber 12. That is, the blower 30*a* may suck and blow out air having a temperature at which snow can be made. However, the blower 30*a* may suck and blow out air adjusted to a temperature different from a temperature in the snow making chamber 12 (a temperature lower than the temperature in the snow making chamber 12).

The snow sticking suppressing means 30 is not limited to the configuration where the blowout pipe 30*b* is connected to the blower 30*a*, and may have a configuration where the blowout pipe 30*b* is omitted. That is, the blower 30*a* may be disposed adjacently to the snow making nozzle 20 at the proximal end 18*a* of the cylindrical body 18, and may be disposed so as to blow out air along the inner surface of the cylindrical body 18 from the proximal end 18*a* toward the distal end 18*b* of the cylindrical body 18.

Figure 2:
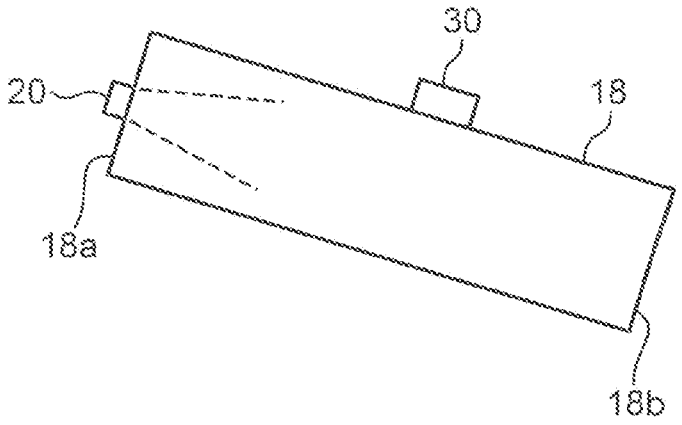
FIG. 2 is a view illustrating a snow sticking suppressing means provided for applying vibration to a cylindrical body.

The snow sticking suppressing means 30 is not limited to the configuration that prevents snow from sticking by allowing air to flow along the inner surface of the cylindrical body 18. For example, as illustrated in FIG. 2, the snow sticking suppressing means 30 may be configured to apply vibration to the cylindrical body 18. In this case, the snow sticking suppressing means 30 is formed of a vibrator or a knocker disposed on an outer side of the cylindrical body 18. The vibrator is brought into contact with an outer surface of the cylindrical body 18 and applies vibration to the cylindrical body 18 as the vibrator vibrates itself. On the other hand, the knocker is disposed away from the cylindrical body 18 and is configured to apply an impact to the cylindrical body 18. That is, the vibrator and the knocker are formed of an instrument that vibrates the cylindrical body 18.

In the snowfall environment test apparatus 1, the inside of the test chamber 2 is adjusted to a temperature environment that reproduces a temperature environment in a cold district, and the inside of the snow making chamber 12 is adjusted to a temperature environment where snow can be produced from water droplets. When a fluid in a state where air and fine water droplets are mixed is jetted from the snow making nozzle 20, a flow of air toward the distal end 18*b* is generated in the cylindrical body 18. At this stage of operation, air in the snow making chamber 12 also flows into the cylindrical body 18 from the proximal end 18*a* of the cylindrical body 18. Therefore, at least a portion of water droplets flowing in the cylindrical body 18 turns into snowflakes. A snow production ratio from water droplets into snow at the outlet of the cylindrical body 18 is influenced by a temperature of air in the snow making chamber 12, a length of the cylindrical body 18, flow velocity of air in the cylindrical body 18, and the like. When the snow production ratio changes, a snow quality also changes.

The air in the cylindrical body 18 which contains snow is guided to the snowfall hood 4 through the pipe member 22, and is blown downward in the test chamber 2. As a result, a snowfall environment is created in the test chamber 2.

As has been described above, in the present exemplary embodiment, when water droplets are jetted from the snow making nozzle 20 on a proximal end 18*a* side of the cylindrical body 18, the jetted water droplets flow in the cylindrical body 18 and turn into snowflakes in the cylindrical body 18. Then, the snowflakes are guided into the test chamber 2 through the pipe member 22. That is, with respect to all snowflakes produced from water droplets jetted from the snow making nozzle 20, a rate of snowflakes that are not guided into the test chamber 2 can be reduced. Therefore, with respect to water droplets jetted from the snow making nozzle 20, a rate of the water droplets to be guided into the test chamber 2 as snowflakes can be increased. Therefore, a running cost of a test where a test piece is exposed to a snowfall environment can be suppressed.

In the present exemplary embodiment, the snow making nozzle 20 is formed of a two-fluid nozzle and hence, the snow making nozzle 20 jets air together with water droplets. With such a configuration, by a force of air which blows off from the snow making nozzle 20, air in the snow making chamber 12 is made to flow into the cylindrical body 18 and air flows in the cylindrical body 18. Therefore, air can be moved in cylindrical body 18 toward the distal end 18*b* even when a blower for allowing air to flow toward the distal end 18*b* is not used in the cylindrical body 18. Accordingly, snow can be blown toward the pipe member 22 without using the blower.

In the present exemplary embodiment, the cylindrical body 18 is disposed above the snowfall hood 4, and the pipe member 22 communicates with the snowfall hood 4. With such a configuration, the pipe member 22 is formed in a shape where the pipe member 22 is bent downward from the inclination direction. Accordingly, it is possible to suppress the deposition of snow in the pipe member 22.

In the present exemplary embodiment, the cylindrical body 18 is disposed in an oblique posture so as to descend from the proximal end 18*a* toward the distal end 18*b*. Accordingly, in the cylindrical body 18, snow and air flow obliquely and downward from the proximal end 18*a* toward the distal end 18*b*. Therefore, it is possible to suppress the deposition of snow in the cylindrical body 18.

Further, in the present exemplary embodiment, the snow making apparatus 1 includes the snow sticking suppressing means 30 for suppressing snow from sticking to the inner surface of the cylindrical body 18. Accordingly, it is possible to suppress snow from sticking to the inner surface of the cylindrical body 18 and hence, a running cost can be further suppressed.

Second Exemplary Embodiment

Figure 3:
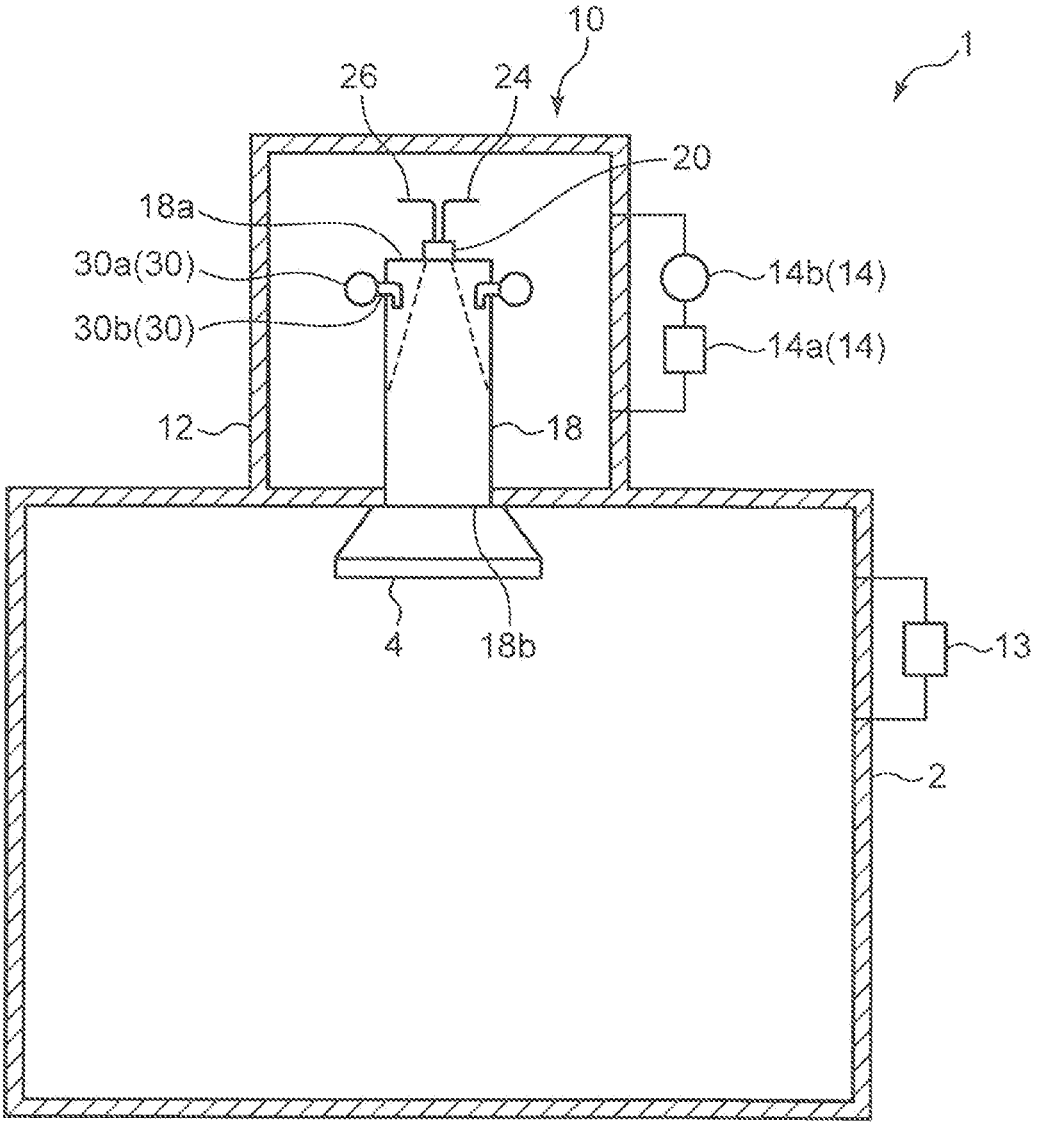
FIG. 3 is a view schematically illustrating a snowfall environment test apparatus to which a snow making apparatus according to a second exemplary embodiment is applied.

FIG. 3 illustrates a snowfall environment test apparatus 1 according to a second exemplary embodiment. In the snowfall environment test apparatus 1 according to the second exemplary embodiment, constituent elements which are identical to corresponding constitutional elements of the snowfall environment test apparatus 1 according to the first exemplary embodiment are denoted by the same reference numerals, and the detailed description of the constituent elements will be omitted.

In the snowfall environment test apparatus 1 according to the second exemplary embodiment, the pipe member 22 is omitted, and a distal end 18*b* of a cylindrical body 18 is directly connected to a snowfall hood 4. In the example shown in FIG. 3, the cylindrical body 18 is formed in a straight line shape. Accordingly, the cylindrical body 18 is disposed in a posture extending in a vertical direction. The cylindrical body 18 may be formed in a bent shape.

The snowfall hood 4 allows snow to fall in a region having an area larger than a cross-sectional area of the cylindrical body 18. In a case where the snow making apparatus 1 includes a plurality of cylindrical bodies 18 and a plurality of snow making nozzles 20, the snowfall hood 4 can be omitted. In this case, a distal end 18*b* of the cylindrical body 18 opens toward a test chamber 2.

Although description of other configurations, operations, and advantageous effects is omitted, the description of the first exemplary embodiment can be applied to the second exemplary embodiment.

Third Exemplary Embodiment

Figure 4:
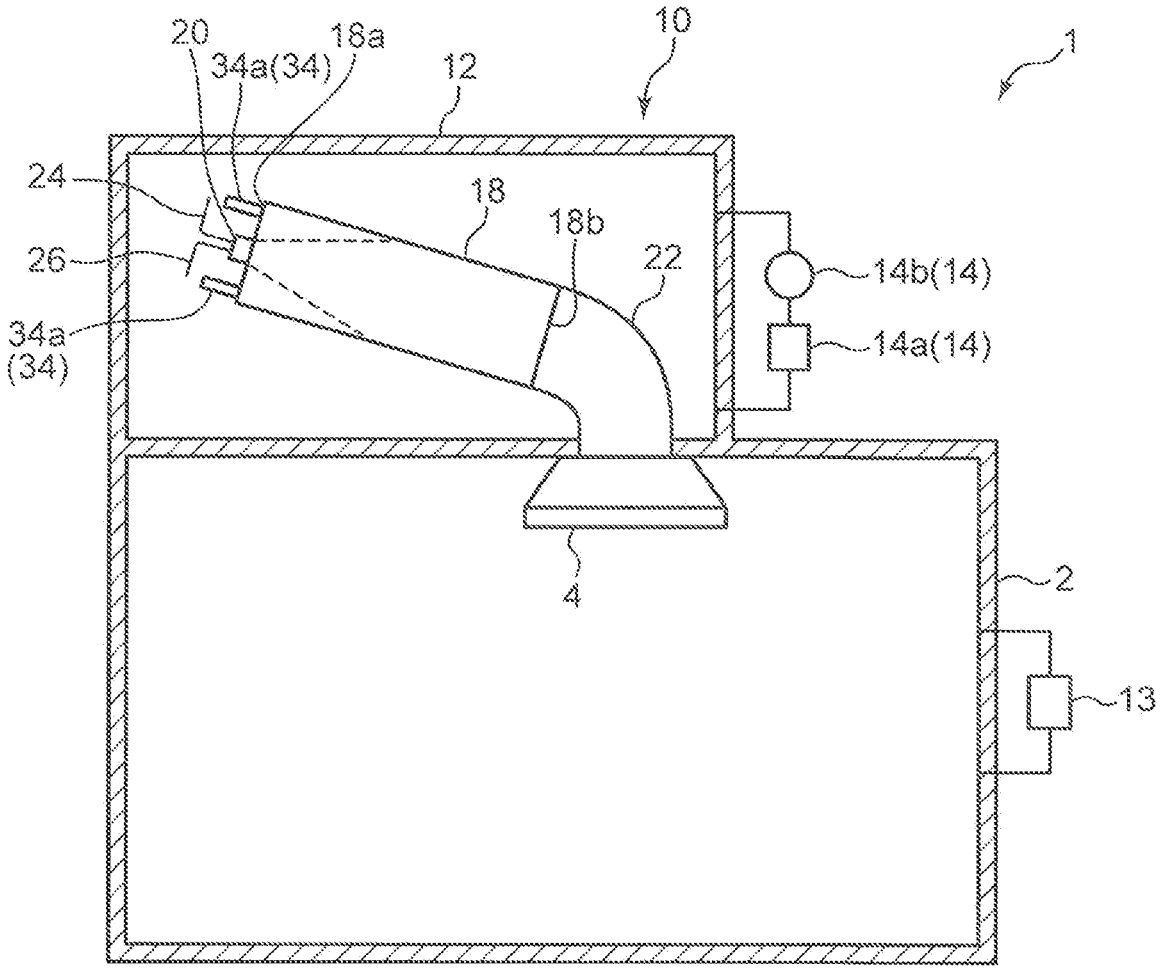
FIG. 4 is a view schematically illustrating a snowfall environment test apparatus to which a snow making apparatus according to a third exemplary embodiment is applied.

FIG. 4 illustrates a snowfall environment test apparatus 1 according to a third exemplary embodiment. In the snowfall environment test apparatus 1 according to the third exemplary embodiment, constituent elements which are identical to corresponding constitutional elements of the snowfall environment test apparatus 1 according to the first exemplary embodiment are denoted by the same reference numerals, and the detailed description of the constituent elements will be omitted.

A snow making apparatus 10 of the third exemplary embodiment includes an auxiliary cooling means (auxiliary cooling unit) 34 that supplies air having a temperature lower than a temperature in a snow making chamber 12. The auxiliary cooling means 34 is configured to supply air of −40° C. or lower, for example, −45° C. or the like, and includes tubular members 34*a* that blow off air toward water droplets jetted from a snow making nozzle 20. The tubular members 34*a* are disposed adjacently to the snow making nozzle 20 at a proximal end 18*a* of a cylindrical body 18.

Air supplied through the tubular members 34*a* directly hits water droplets jetted from the snow making nozzle 20 and hence, water droplets can be efficiently solidified. In addition, with the provision of the auxiliary cooling means 34, it is not necessary to cool the whole snow making chamber 12 to about −40° C. or less.

Therefore, in the present exemplary embodiment, water droplets jetted from the snow making nozzle 20 are cooled to a temperature at which snow can be produced with a temperature environment where the cylindrical body 18 is disposed, and the water droplets are also cooled by the auxiliary cooling means 34. Accordingly, the snow production efficiency can be enhanced. In addition, the auxiliary cooling means 34 locally cools water droplets and hence, it is possible to suppress an increase in energy required for cooling. In addition, cooling air is blown from the tubular members 34*a* and hence, it is possible to suppress snow from sticking to an inner surface of a cylindrical body 18 by this airflow, and it is also possible to separate the stuck snow from the inner surface of the cylindrical body 18. That is, the tubular members 34*a* that generate an airflow along the inner surface of the cylindrical body 18 also function as a snow sticking suppressing means 30 that suppresses the sticking of snow.

The auxiliary cooling means 34 is not limited to the configuration where air is blown into a space in the cylindrical body 18. Alternatively, the auxiliary cooling means 34 may be configured to cool the cylindrical body 18 itself. For example, the auxiliary cooling means 34 may include a cooling pipe that is wound around the cylindrical body 18. Alternatively, the auxiliary cooling means 34 may be formed such that an outer cylinder is disposed around the cylindrical body 18, and a cooling medium may be allowed to flow between the cylindrical body 18 and the outer cylinder.

In FIG. 4, the snow sticking suppressing means 30 is not illustrated. However, the snow making apparatus 10 of the third exemplary embodiment may include the snow sticking suppressing means 30. Although the description of other configurations, operations, and advantageous effects is omitted, the description of the first and second exemplary embodiments can be applied to the third exemplary embodiment.

Fourth Exemplary Embodiment

Figure 5:
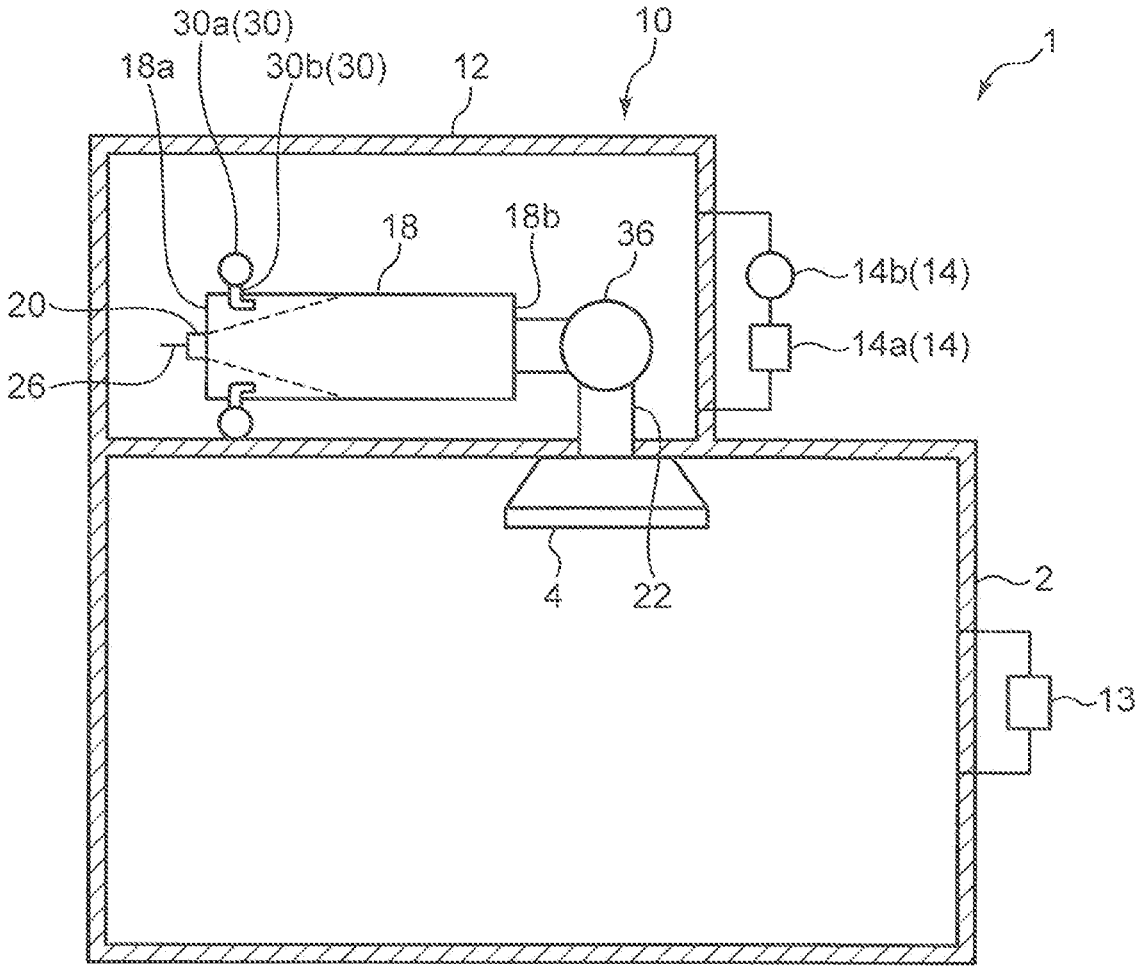
FIG. 5 is a view schematically illustrating a snowfall environment test apparatus to which a snow making apparatus according to a fourth exemplary embodiment is applied.

FIG. 5 illustrates a snowfall environment test apparatus 1 according to a fourth exemplary embodiment. In the snowfall environment test apparatus 1 according to the fourth exemplary embodiment, constituent elements which are identical to corresponding constitutional elements of the snowfall environment test apparatus 1 according to the first exemplary embodiment are denoted by the same reference numerals, and the detailed description of the constituent elements will be omitted.

The fourth exemplary embodiment differs from the first exemplary embodiment with respect to a point that a snow making nozzle 20 of the fourth exemplary embodiment is formed of a one-fluid nozzle while the snow making nozzle 20 of the first exemplary embodiment is formed of a two-fluid nozzle. The cold water supply path 26 is connected to the snow making nozzle 20. On the other hand, the air supply path 24 is not connected to the snow making nozzle 20. Therefore, the snow making nozzle 20 squeezes supplied cold water and, then, jets water droplets from a jetting opening.

A pipe member 22 connected to a cylindrical body 18 includes a blower 36. When the blower 36 is operated, air in the cylindrical body 18 flows by a suctioning action of the blower 36. Therefore, in the present exemplary embodiment, the air in the cylindrical body 18 is not made to flow by a force generated by jetting of water droplets from the snow making nozzle 20. Instead, air in the cylindrical body 18 is made to flow using a drive force of the blower 36.

Instead of causing air to flow by making use of a sucking action of the blower 36, air may be made to flow in the cylindrical body 18 by making use of a pushing action of the blower 36. That is, the blower 36 may be disposed on a back side of the snow making nozzle 20, and the blower 36 may blow air toward the snow making nozzle 20 (that is, toward the inside of the cylindrical body 18).

FIG. 5 illustrates an example where the cylindrical body 18 is arranged in a horizontal direction. However, the present embodiment is not limited to such an arrangement, and the cylindrical body 18 may be arranged in an inclined posture or in a vertical posture. In addition, the shape of the pipe member 22 is not limited to a shape illustrated in FIG. 5. Furthermore, in a case where the cylindrical body 18 extends toward a test chamber 2, the pipe member 22 can be omitted.

Although description of other configurations, operations, and advantageous effects is omitted, the description of the first to third exemplary embodiments can be applied to the fourth exemplary embodiment.

Fifth Exemplary Embodiment

Figure 6A:
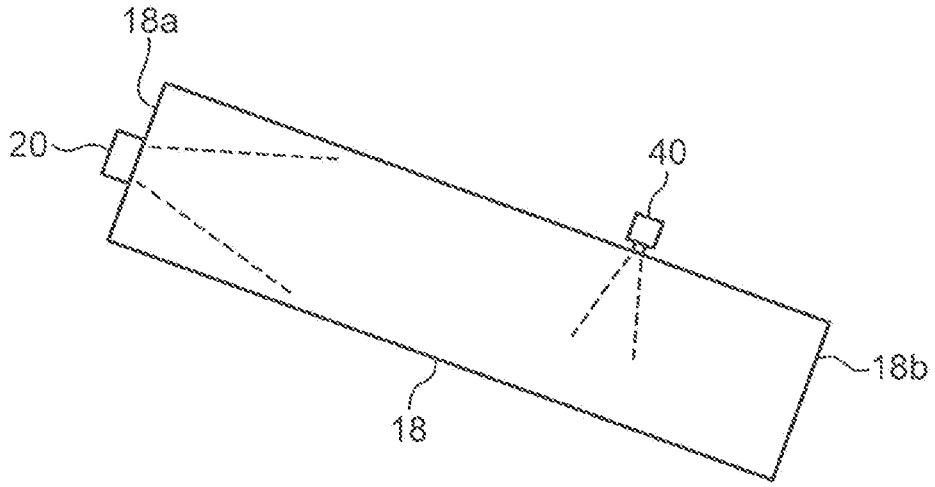
FIGS. 6A and 6B are views for explaining a snow quality adjustment nozzle disposed in a snow making apparatus according to a fifth exemplary embodiment.
Figure 6B:
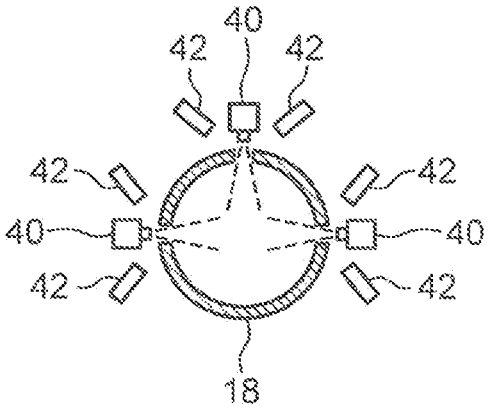

FIG. 6A and FIG. 6B illustrate a snowfall environment test apparatus 1 according to a fifth exemplary embodiment. In the snowfall environment test apparatus 1 according to the fifth exemplary embodiment, constituent elements which are identical to corresponding constitutional elements of the snowfall environment test apparatus 1 according to the first exemplary embodiment are denoted by the same reference numerals, and the detailed description of the constituent elements will be omitted.

A snow making apparatus 10 according to the fifth exemplary embodiment includes snow-quality adjustment nozzles 40 for moistening snow produced in a cylindrical body 18. Each snow-quality adjustment nozzle 40 is formed of a nozzle that jets water droplets. The snow-quality adjustment nozzles 40 are disposed at a position close to a distal end 18*b* of the cylindrical body 18. That is, the snow-quality adjustment nozzles 40 are disposed at the position closer to the distal end 18*b* of the cylindrical body 18 than to the proximal end 18*a*. With such a configuration, the snow-quality adjustment nozzle 40 moistens snow before the snow flows out from the distal end 18*b* of the cylindrical body 18.

The snow-quality adjustment nozzles 40 are disposed outside the cylindrical body 18, and jet water droplets into the cylindrical body 18 through through holes formed in the cylindrical body 18. Since the snow-quality adjustment nozzles 40 are positioned outside the cylindrical body 18, snow flowing in the cylindrical body 18 is suppressed from sticking to the snow-quality adjustment nozzles 40.

As shown in FIG. 6B, the snow making apparatus 10 according to the fifth exemplary embodiment may include a plurality of snow-quality adjustment nozzles 40. These snow-quality adjustment nozzles 40 may be arranged at intervals in a circumferential direction of the cylindrical body 18 so as to supply water droplets from a plurality of directions toward a radially inner side of the cylindrical body 18. Only a single snow-quality adjustment nozzle 40 may be disposed in the circumferential direction, or the plurality of snow-quality adjustment nozzles 40 may be disposed so as to be aligned in the axial direction.

In the vicinity of each snow-quality adjustment nozzle 40, pipes 42 that blow air toward a distal end of the snow-quality adjustment nozzle 40 are disposed. Since the air blown from the pipes 42 is blown onto the distal end of the snow-quality adjustment nozzle 40, the distal end of the snow-quality adjustment nozzle 40 is prevented from freezing. In FIG. 6B, the pipes 42 are arranged at positions adjacently to the snow-quality adjustment nozzle 40 in the circumferential direction. However, the pipes 42 may be arranged at any sides with respect to the snow-quality adjustment nozzle 40 as long as the pipes 42 extend toward the distal end of the snow-quality adjustment nozzle 40. A compressed air source (not illustrated) is connected to the pipes 42. The pipes 42 can be omitted.

Figure 7:
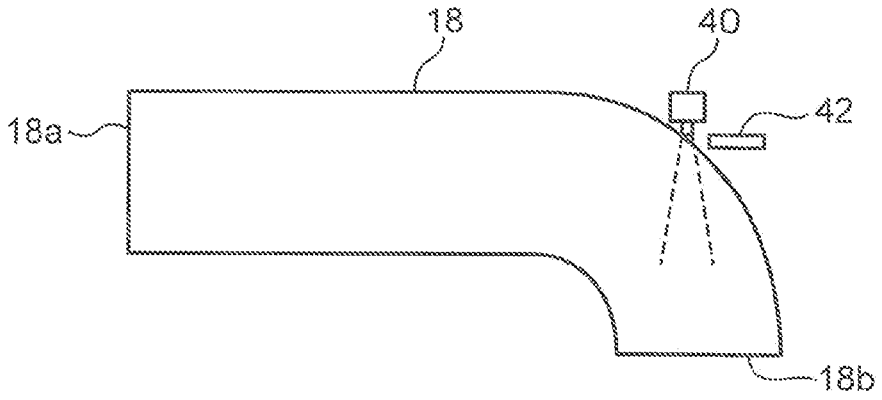
FIG. 7 is a view for explaining a modification of the snow quality adjustment nozzle.

FIG. 6A illustrates an example where the snow-quality adjustment nozzle 40 is provided with the cylindrical body 18 extending in a straight line. However, FIG. 7 illustrates a case where the snow-quality adjustment nozzle 40 is provided with a cylindrical body 18 having a bent shape. In this case, the snow-quality adjustment nozzle 40 is disposed at an elbow of the cylindrical body 18 and jets water droplets toward the distal end 18*b* of the cylindrical body 18.

FIG. 6A and FIG. 7 illustrate an example where the snow-quality adjustment nozzles 40 is disposed in the vicinity of the distal end 18*b* of the cylindrical body 18. However, the snow-quality adjustment nozzle 40 may be disposed at the distal end 18*b* of the cylindrical body 18. Alternatively, the snow-quality adjustment nozzles 40 may be disposed at a position more downstream of the distal end 18*b* (away from the distal end 18*b*), and may moisten snow flowing out from the cylindrical body 18 at the position. In this case, the snow-quality adjustment nozzles 40 may be provided with a pipe member 22.

Although the description of other configurations, operations, and effects is omitted, the description of the first to fourth exemplary embodiments can be applied to the fifth exemplary embodiment.

Sixth Exemplary Embodiment

Figure 8:
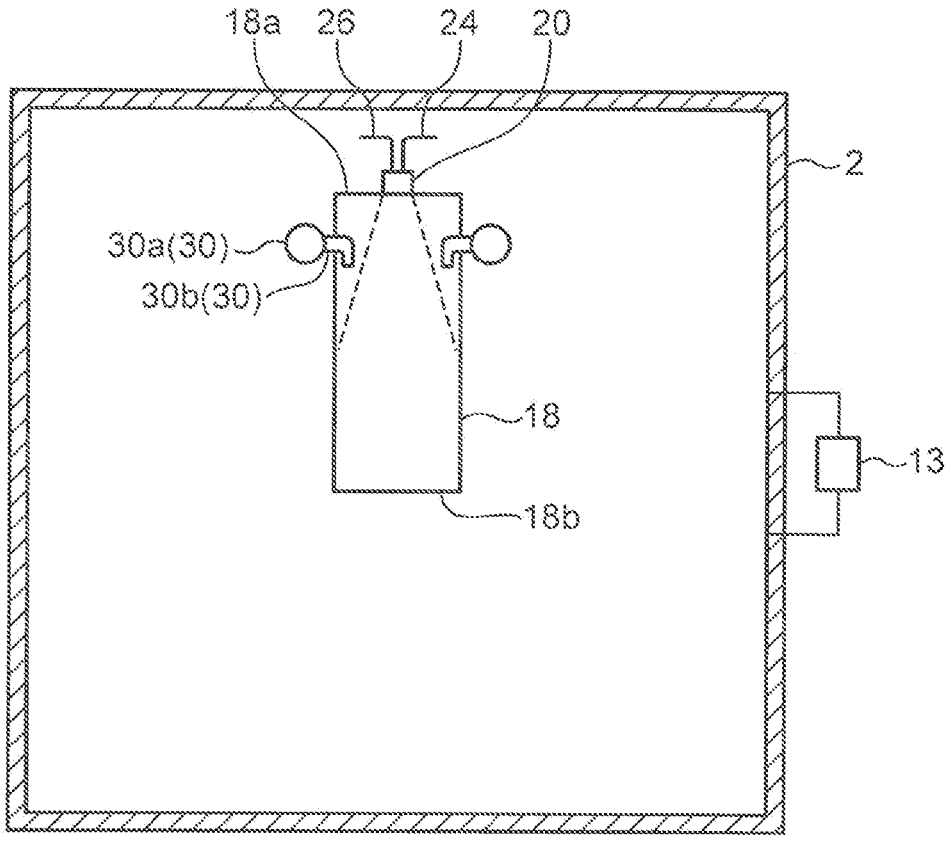
FIG. 8 is a view schematically illustrating a snowfall environment test apparatus to which a snow making apparatus according to a sixth exemplary embodiment is applied.

FIG. 8 illustrates a snowfall environment test apparatus 1 according to a sixth exemplary embodiment. In the snowfall environment test apparatus 1 according to the sixth exemplary embodiment, constituent elements which are identical to corresponding constitutional elements of the snowfall environment test apparatus 1 according to the first exemplary embodiment are denoted by the same reference numerals, and the detailed description of the constituent elements will be omitted.

In the first exemplary embodiment, the description has been made with respect to the snowfall environment test apparatus 1 where the snow making chamber 12 is provided additionally or separately from the test chamber 2. However, in the sixth exemplary embodiment, the snowfall environment test apparatus 1 does not include the snow making chamber 12. That is, the inside of a test chamber 2 is adjusted to a temperature environment where snow can be produced from water droplets. Therefore, an air conditioner 13 in the test chamber 2 is configured to cool air in the test chamber 2 to a temperature at which snow can be produced.

A cylindrical body 18 is disposed in the test chamber 2, and air in the test chamber 2 flows into the cylindrical body 18 through a proximal end 18*a* of the cylindrical body 18 which is opened to the test chamber 2. The cylindrical body 18 is disposed in a posture extending in the vertical direction such that the proximal end 18*a* of the cylindrical body 18 is positioned on an upper side. With such a configuration, a snow making nozzle 20 jets water droplets downward into the cylindrical body 18. No pipe member 22 is connected to a distal end 18*b* (lower end) of the cylindrical body 18.

Accordingly, air containing snow which flows out from the cylindrical body 18 flows toward a test piece disposed below the cylindrical body 18.

Figure 9:
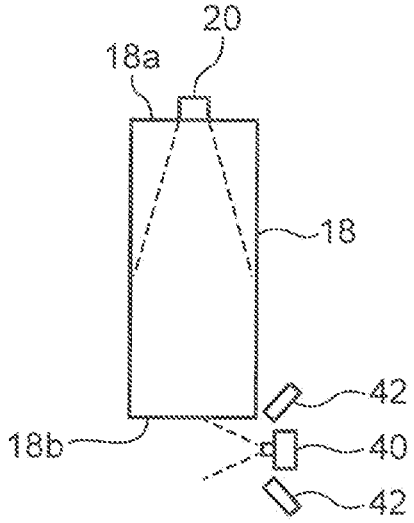
FIG. 9 is a view for explaining a modification of the snow quality adjustment nozzle.

As illustrated in FIG. 9, the snowfall environment test apparatus 1 may include a snow-quality adjustment nozzle 40. In this case, the snow-quality adjustment nozzle 40 is disposed downstream of a distal end 18*b* of a cylindrical body 18, and the snow-quality adjustment nozzle 40 blows water droplets toward snow flowing out from the cylindrical body 18. Instead of such a configuration, the snow-quality adjustment nozzle 40 may be disposed at a position between the distal end 18*b* and a proximal end 18*a* of the cylindrical body 18. In this case, the snow-quality adjustment nozzle 40 supplies water droplets to snow flowing in the cylindrical body 18 through a through hole formed in the cylindrical body 18.

Figure 10:
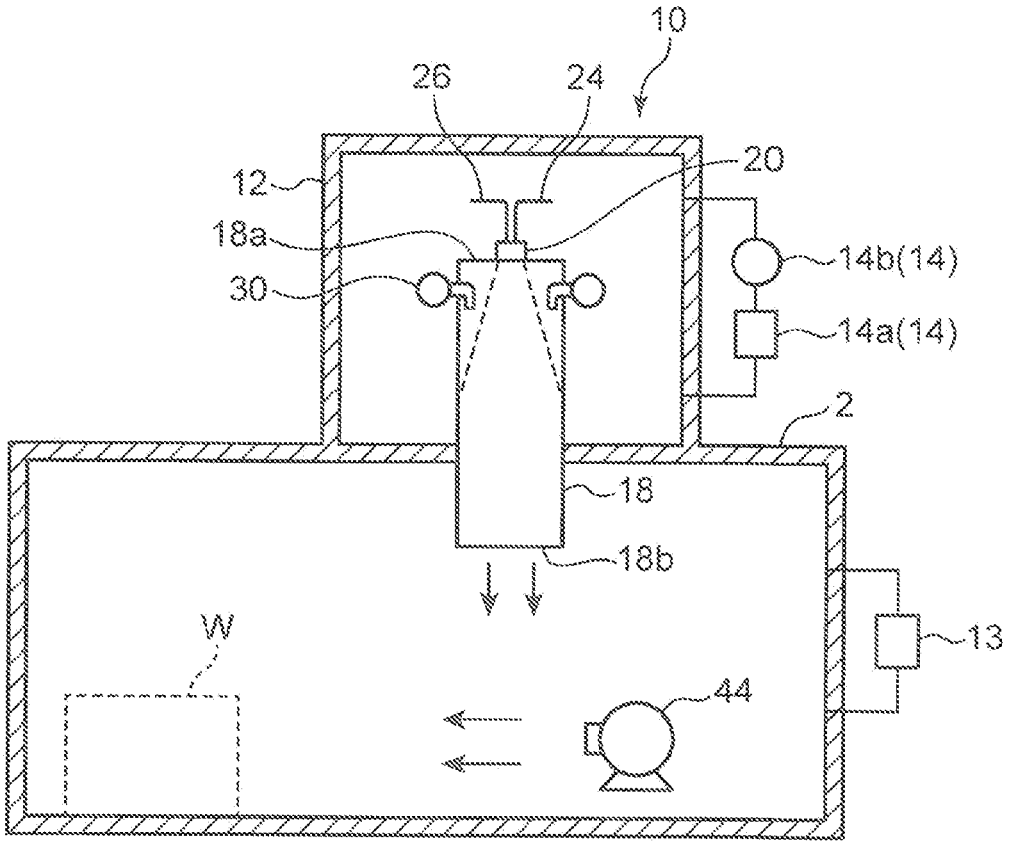
FIG. 10 is a view schematically illustrating a snowfall environment test apparatus to which a snow making apparatus according to a modification of the sixth exemplary embodiment is applied.

The cylindrical body 18 may have the distal end 18*b* which is opened toward a test piece W disposed in the test chamber 2. However, the distal end 18*b* may be opened in a direction different from the direction toward the test piece W as illustrated in FIG. 10. In this case, in the test chamber 2, a blower 44 that changes air flowing out from the distal end 18*b* of the cylindrical body 18 into an airflow toward the test piece W is disposed. With such a configuration, snow flowing out from the cylindrical body 18 is blown onto a front surface (or a side surface) of the test piece W. Even in such a case, the distal end 18*b* of the cylindrical body 18 is opened so that air flows toward the test piece W. The cylindrical body 18 is disposed across the snow making chamber 12 and the test chamber 2, the proximal end 18*a* is opened to the snow making chamber 12, and the distal end 18*b* is opened in the test chamber 2. Therefore, air in the snow making chamber 12 flows into the cylindrical body 18, and air containing snow flows out into the test chamber 2.

Figure 11:
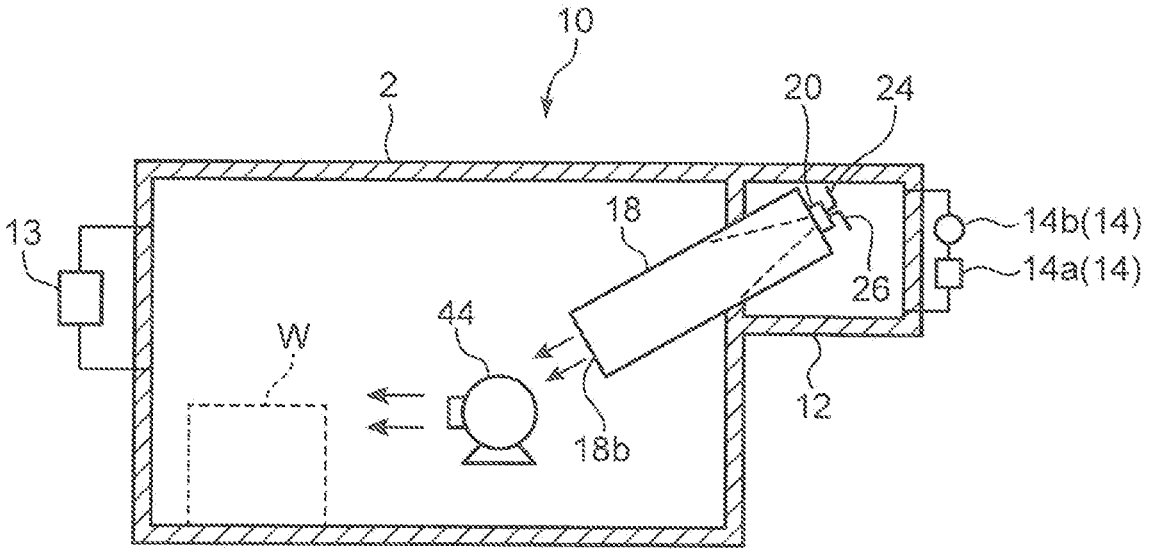
FIG. 11 is a view schematically illustrating a snowfall environment test apparatus to which a snow making apparatus according to another modification of the sixth exemplary embodiment is applied.
Figure 17:
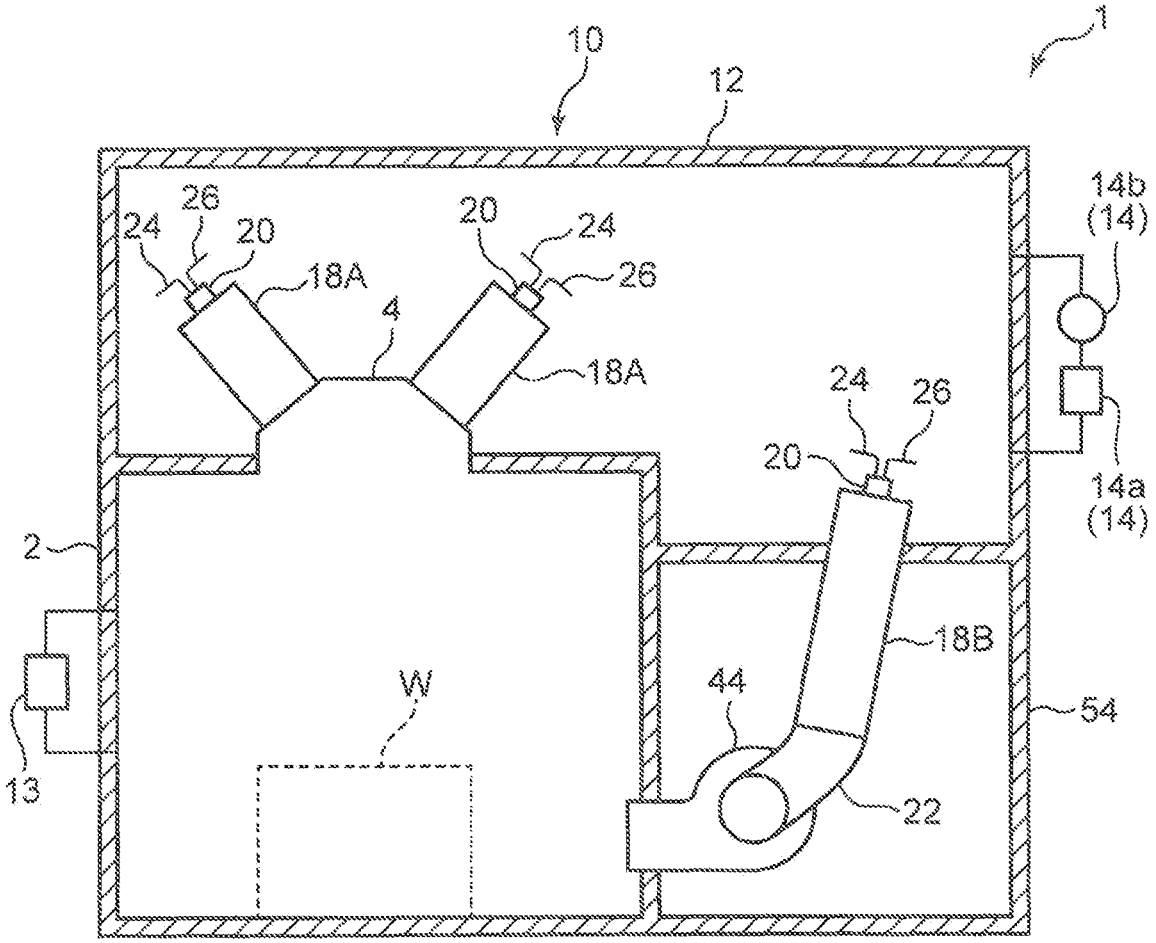
FIG. 17 is a view schematically illustrating a snowfall environment test apparatus to which a snow making apparatus according to another exemplary embodiment is applied.

In FIG. 10, the distal end 18*b* of the cylindrical body 18 is directed toward a blow-off side of the blower 44. However, as illustrated in FIG. 11, a distal end 18*b* of a cylindrical body 18 may be directed toward a suction side of a blower 44. In the configuration illustrated in FIG. 11, the snowfall environment test apparatus 1 may include a pipe member 22 which connects the distal end 18*b* of the cylindrical body 18 and the blower 44 to each other. That is, air which flows out from the cylindrical body 18 may be sucked into the blower 44 through the pipe member 22. In place of such a configuration, the distal end of the cylindrical body 18 may be directly connected to the blower 44. That is, the configuration may be adopted where the distal end of the cylindrical body 18 may be opened so that air flows toward the test piece or the test chamber 2 via the blower 44. The blowers 44 illustrated in FIG. 10 and FIG. 11 may be configured such that a rotational speed of the blower 44 can be changed. In this case, a wind speed of air which is blown to the test piece W can be changed. The arrangement of the blower 44 is not limited to the arrangement where the blower is disposed in the test chamber 2. As will be described later with respect to FIG. 17, a blower 44 may be disposed in a blower chamber 54.

In FIG. 10, the cylindrical body 18 is in a posture extending in a vertical direction, and in FIG. 11, the cylindrical body 18 is in a posture extending in an oblique direction. However, in the present embodiment, the cylindrical body 18 is not limited to such postures. In addition, in place of the configuration where the distal end 18*b* of the cylindrical body 18 opens in the test chamber 2 and allows air to directly flow out into the test chamber 2, a pipe member 22 that is disposed in the test chamber 2 may be connected to the distal end 18*b* to allow air to flow out into the test chamber 2 through the pipe member 22.

Although the description of other configurations, operations, and advantageous effects is omitted, the description of the first to fifth exemplary embodiments can be applied to the sixth exemplary embodiment.

Other Exemplary Embodiments

It should be construed that the exemplary embodiments disclosed in the specification are illustrative and are not limitative in all aspects. The present invention is not limited to the above-mentioned exemplary embodiments, and various modifications, improvements and the like are conceivable without departing from the gist of the present invention. For example, in the first to fifth exemplary embodiments, the examples have been described where the snow making apparatus 10 is applied to the snowfall environment test apparatus 1 configured such that the snow making chamber 12 is disposed on the upper side of the test chamber 2. However, the snow making chamber 12 may be disposed on a side of the test chamber 2. In this case, the cylindrical body 18 may be located at the position higher than the position of the snowfall hood 4, or may be located at the same height as the snowfall hood 4 or at the position below the height of the snowfall hood 4. In such cases, a blower 36 is mounted on the pipe member 22 which connects the cylindrical body 18 and the snowfall hood 4 to each other.

In the first to fifth exemplary embodiments, the snowfall hood 4 may be omitted.

In the first to sixth exemplary embodiments, the examples are described where the snowfall environment test apparatus 1 includes a single cylindrical body 18 and a single snow making nozzle 20. However, a plurality of snow making nozzles 20 may be mounted on the single cylindrical body 18. Further, the snowfall environment test apparatus 1 may include the plurality of cylindrical bodies 18, and the snow making nozzle 20 may be disposed in each cylindrical body 18.

Figure 12:
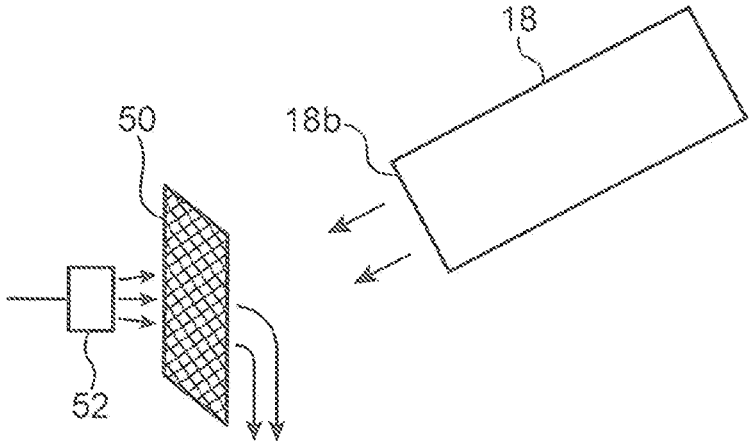
FIG. 12 is a view illustrating another exemplary embodiment of a configuration in which a snow growth promoting member is disposed in the vicinity of a distal end of the cylindrical body.
Figure 13:
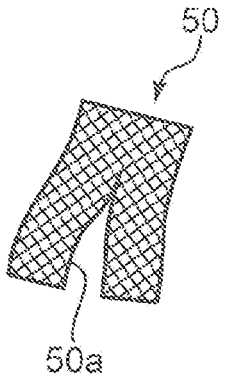
FIG. 13 is a view illustrating a modification of the snow growth promoting member.
Figure 14:
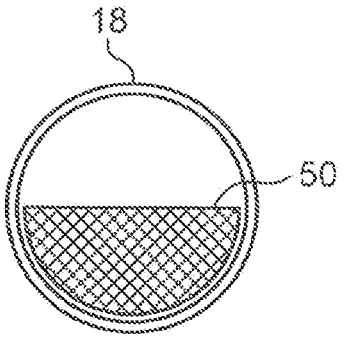
FIG. 14 is a view illustrating another modification of the snow growth promoting member.

In the first to sixth exemplary embodiments, snowflakes produced in the cylindrical body 18 flow into the test chamber 2 while keeping the same size. However, the present embodiments are not limited to such a configuration. For example, as illustrated in FIG. 12, the snowfall environment test apparatus 1 may include a snow growth promoting member 50 that temporarily captures snow produced by the cylindrical body 18 and grows the captured snow. The snow growth promoting member 50 is formed of a mesh-like member, a fiber material, or a sheet member to which fluororesin coating is applied, wherein snow can be stuck on these materials. The snow growth promoting member 50 is disposed at the position where air flowing out from the cylindrical body 18 flows. The snow growth promoting member 50 may be formed of a mesh-like member having a polygonal shape such as a rectangular shape, a square shape, a hexagonal shape, or an octagonal shape. In addition, as illustrated in FIG. 13, the snow growth promoting member 50 may be formed such that a slit 50*a* is formed in one side of a rectangular mesh-like member having a rectangular shape by cutting. In this case, the snow growth promoting member 50 catches snow while portions of the snow growth promoting member 50 disposed on both sides of the slit 50*a* are swung by an airflow. The snow growth promoting member 50 may be disposed in the cylindrical body 18. In this case, as shown in FIG. 14, the snow growth promoting member 50 may be formed of a semicircular mesh-like member, and may be disposed inside the cylindrical body 18 in a state where the snow growth promoting member 50 is not brought into contact with an inner surface of the cylindrical body 18.

The cylindrical body 18 may be formed in a cylindrical shape having a circular cross section, may be formed in an oval cylindrical shape having an elliptical cross section or the like, or may be formed in a cylindrical shape having a polygonal cross section. In addition, the cylindrical body 18 may be formed in a cylindrical shape having a cross-sectional shape obtained by combining curved lines and straight lines, for example, like an elongated hole shape.

It is sufficient for the cylindrical body 18 that a proximal end 18*a* of the cylindrical body 18 is opened to a temperature environment where snow can be produced. The whole cylindrical body 18 may not be disposed in a temperature environment where snow can be produced. For example, the cylindrical body 18 may be disposed across a plurality of spaces.

The snow growth promoting member 50 may be configured such that the snow growth promoting member 50 swings by air blown off from the cylindrical body 18 or by air flowing in the cylindrical body 18. In this case, the snow captured and grown by the snow growth promoting member 50 falls from the snow growth promoting member 50 by swinging the snow growth promoting member 50. However, the present embodiment is not limited to such a configuration. For example, a vibrator 52 that vibrates the snow growth promoting member 50 may be provided as shown in FIG. 12. The vibrator 52 may be, for example, a nozzle that intermittently jets compressed air toward the snow growth promoting member 50, or may be a knocker that applies an impact to the snow growth promoting member 50 or a vibrator that vibrates the snow growth promoting member 50.

The snow growth promoting member 50 may be supported by any method as long as the snow growth promoting member 50 is disposed in the vicinity of the distal end 18*b* of the cylindrical body 18. For example, FIG. 15 illustrates the configuration where the snow growth promoting member 50 is attached to the distal end 18*b* of the cylindrical body 18.

Figure 15:
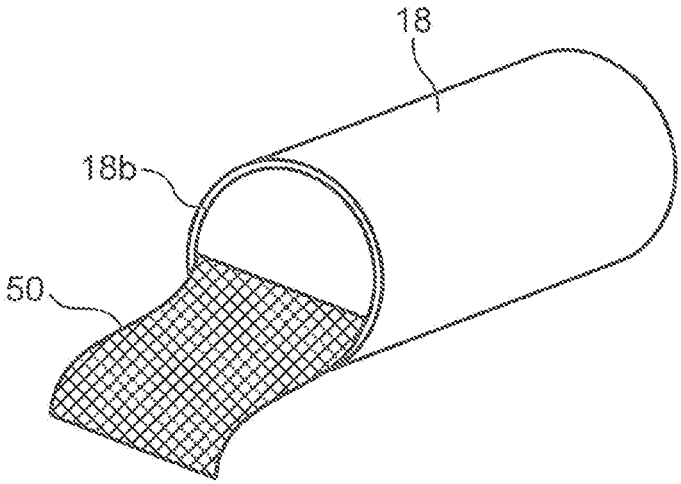
FIG. 15 is a view illustrating a configuration in which the snow growth promoting member is attached to the distal end of the cylindrical body.

As illustrated in FIG. 15, the snow growth promoting member 50 may be formed in a flat shape such that the snow growth promoting member 50 swings by air flowing out from the cylindrical body 18, and may be attached to the distal end 18*b* such that the snow growth promoting member 50 traverses the center at the distal end 18*b* of the cylindrical body 18. The snow growth promoting member 50 is not necessarily be attached to a position where the snow growth promoting member 50 traverses the center at the distal end 18*b* of the cylindrical body 18. The snow growth promoting member 50 may be attached at the position displaced from the center. In this case, a plurality of snow growth promoting members 50 may be attached. In FIG. 15, the snow growth promoting member 50 is configured such that one side which traverses the distal end 18*b* of the cylindrical body 18 is directed in a horizontal direction. However, the present embodiment is not limited to such a configuration. The snow growth promoting member 50 may be attached to the cylindrical body 18 in a state where one side which traverses the distal end 18*b* of the cylindrical body 18 is directed in a vertical direction, or may be attached to the cylindrical body 18 in an oblique state.

In FIG. 12 to FIG. 15, the configuration where only single snow growth promoting member 50 is provided is illustrated. However, a plurality of snow growth promoting members 50 may be provided.

Figure 16A:
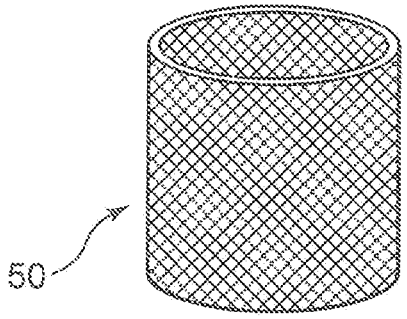
FIG. 16A and FIG. 16B are views illustrating snow growth promoting members formed in a cylindrical shape.
Figure 16B:
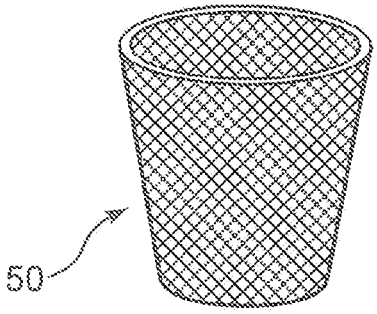

As illustrated in FIG. 16A and FIG. 16B, a snow growth promoting member 50 may be formed in a cylindrical shape in accordance with the shape of a distal end 18*b*. In this case, the snow growth promoting member 50 may be formed in a cylindrical shape having the same diameter in an axial direction, or may be formed in a tapered shape where the diameter is made smaller in the axial direction.

In the snowfall environment test apparatuses 1 of the exemplary embodiments described above, the cylindrical body 18 is disposed so as to allow snow to fall toward the test piece W (see, for example, FIG. 1), or the cylindrical body 18 is disposed so as to allow air containing snow to flow out toward the blower 44 that blows the air toward the test piece W (see, for example, FIG. 10). On the other hand, the snowfall environment test apparatus 1 illustrated in FIG. 17 includes cylindrical bodies (first cylindrical bodies) 18A disposed so as to allow snow to fall toward the test piece W, and a cylindrical body (second cylindrical body) 18B connected to a blower 44 that blows air toward the test piece W. The proximal ends of the first cylindrical bodies 18A and the proximal end of the second cylindrical body 18B are opened to a snow making chamber 12 which is a temperature environment where snow can be produced. The snowfall environment test apparatus 1 includes two first cylindrical bodies 18A in FIG. 17. However, the number of first cylindrical bodies 18A is not limited, and the snowfall environment test apparatus 1 may include only one first cylindrical body 18A or three or more first cylindrical bodies 18A. Each of the two first cylindrical bodies 18A is connected to a snowfall hood 4, and snow produced in the first cylindrical body 18A falls through the snowfall hood 4 from above the test piece W toward the test piece W in the test chamber 2. On the other hand, snow produced in the second cylindrical body 18B is suctioned by the blower 44, and the blower 44 blows air containing the suctioned snow toward the test piece W. Therefore, the snow can be blown toward the test piece W at a predetermined wind speed. The blower 44 is disposed in a blower chamber 54 disposed adjacently to the test chamber 2. The blower chamber 54 may not be a temperature environment where snow can be produced, and may be omitted. Even in such a case, since a proximal end 18*a* of the second cylindrical body 18B is opened to a temperature environment (snow making chamber 12) where snow can be produced, it is possible to produce snow in the second cylindrical body 18B.

The second cylindrical body 18B may be directly connected to the blower 44 or may be connected to the blower 44 by way of a pipe member 22. The snowfall environment test apparatus 1 may include two or more second cylindrical bodies 18B. In this case, a plurality of second cylindrical bodies 18B may be connected to one blower 44. Alternatively, the snowfall environment test apparatus 1 may include a plurality of blowers 44 and the second cylindrical body 18B are connected to the respective blowers 44.

In the present exemplary embodiment, the snowfall environment test apparatus 1 includes: the first cylindrical bodies 18A which are disposed such that the first cylindrical bodies 18A allow snow to fall toward the test piece W; and the second cylindrical body 18B which are connected to the blower 44 such that the second cylindrical body 18B blows air toward the test piece W. Accordingly, a snowfall mode can be selected in response to a required test. Specifically, a test where snow is made to fall by using the first cylindrical bodies 18A can be selected and performed, and a test where snow is blown onto the test piece W using the second cylindrical body 18B can also be selected and performed.

One or a plurality of snow making nozzles 20 may be mounted on the single first cylindrical body 18A. Similarly, one or a plurality of snow making nozzles 20 may be mounted on the single second cylindrical body 18B.

The first cylindrical body 18A and the second cylindrical body 18B may be formed in a cylindrical shape having a circular cross section, may be formed in an oval cylindrical shape having an elliptical cross section, or may be formed in a cylindrical shape having a polygonal cross section. In addition, the cylindrical body 18 may be formed in a cylindrical shape having a cross-sectional shape obtained by combining curved lines and straight lines, for example, like an elongated hole shape.

The above-mentioned exemplary embodiments is recapitulated as follows.

(1) In the exemplary embodiments, the snow making apparatus according to the exemplary embodiment includes: a cylindrical body; and a snow making nozzle configured to jet water droplets into the cylindrical body. The cylindrical body has a proximal end that is opened to a temperature environment where snow can be produced from water droplets jetted from the snow making nozzle. A distal end of the cylindrical body is opened so that air flows toward a test piece or a test chamber, or is connected to a pipe member which opens so that the air flows toward the test piece, or is connected to a pipe member which is connected to the test chamber.

In the snow making apparatus, when water droplets are jetted from the snow making nozzle, the jetted water droplets flow in the cylindrical body and turns into snowflakes in the cylindrical body. Then, the snowflakes are blown from the cylindrical body so that air flows toward the test piece or the test chamber, are blown so that air flows toward the test piece through the pipe member, or are guided into the test chamber. That is, it is possible to reduce a ratio of snowflakes which do not flow toward the test piece or snowflakes which are not guided into the test chamber among snowflakes produced from water droplets jetted from the snow making nozzle. Therefore, with respect to water droplets which are jetted from the snow making nozzle, it is possible to improve a ratio of the water droplets which are blown toward the test piece as snowflakes or a ratio of water droplets to be guided into the test chamber as snowflakes. Therefore, a running cost of a test where a test piece is exposed to a snowfall environment can be suppressed.

(2) The snow making nozzle may be formed of a two-fluid nozzle. With such a configuration, the snow making nozzle jets air together with water droplets. Therefore, the air flows in the cylindrical body by a force generated by air which blows from the snow making nozzle. In other words, the snow making nozzle also functions as a drive source that allows air in the cylindrical body to flow. Therefore, since the air can be flowed without using the blower for flowing the air toward the distal end in the cylindrical body, snow can be blown from the cylindrical body so that the air flows toward the test piece, the test chamber, and the pipe member without using the blower.

(3) The distal end of the cylindrical body or the pipe member may be connected to the snowfall hood which has the supply opening through which snow is allowed to fall and is disposed in the test chamber. In this case, the cylindrical body may be disposed such that the snow in the cylindrical body flows toward the snowfall hood from an upper side to a lower side.

With such a configuration, when the distal end of the cylindrical body communicates with the snowfall hood, snow flows downward from the cylindrical body toward the snowfall hood. Therefore, it is possible to suppress snow from being deposited in the portion. In addition, when the pipe member communicates with the snowfall hood, since the pipe member is disposed in the vertical direction or in the inclined direction, it is possible to suppress snow from being deposited in the pipe member.

(4) The snow making apparatus may further include the blower configured to suction air flowing out from the distal end of the cylindrical body or the pipe member and blows the air toward the test piece.

With such a configuration, the air flowing out from the distal end of the cylindrical body or the pipe member is suctioned into the blower. The blower blows suctioned air containing snow toward the test piece. Therefore, it is possible to blow snow at a predetermined wind speed toward the test piece.

(5) The cylindrical body may be disposed in an oblique posture so as to descend from the proximal end toward the distal end. With such a configuration, snow flows obliquely downward from the proximal end side toward the distal end in the cylindrical body, the snow making nozzle being disposed at the proximal end side. Therefore, it is possible to suppress snow from being deposited in the cylindrical body.

(6) The snow making apparatus may include the snow sticking suppressing means for suppressing snow from sticking to the inner surface of the cylindrical body. With such a configuration, since it is possible to suppress snow from sticking to the inner surface of the cylindrical body, it is possible to further suppress the running cost.

(7) The snow sticking suppressing means may include the blower that allows air to flow along the inner surface of the cylindrical body. With such a configuration, the air blown from the blower flows along the inner surface of the cylindrical body and hence, the snow in the cylindrical body can be suppressed from sticking to the inner surface of the cylindrical body, or the stuck snow can be detached from the inner surface of the cylindrical body.

(8) The snow sticking suppressing means may be configured to apply vibration to the cylindrical body. With such a configuration, when the cylindrical body vibrates, snow in the cylindrical body can be suppressed from sticking to the inner surface of the cylindrical body, or the stuck snow can be detached from the inner surface of the cylindrical body.

(9) The snow making apparatus may include the snow-quality adjustment nozzle for moistening snow produced in the cylindrical body. With such a configuration, since the quality of the snow produced in the cylindrical body can be changed, snow having different quality determined by a temperature and humidity environment to which the proximal end of the cylindrical body is opened can be supplied to the test piece or the test chamber.

(10) The snow making apparatus may include the auxiliary cooling means configured to blow air toward water droplets jetted from the snow making nozzle, the air having a temperature lower than a temperature in the temperature environment where the proximal end of the cylindrical body is opened. With such a configuration, the water droplets jetted from the snow making nozzle are cooled to the temperature at which snow can be produced with a temperature environment where the proximal end of the cylindrical body is opened, and the water droplets are also cooled by the auxiliary cooling means. Therefore, the snow production efficiency can be enhanced. In addition, since the auxiliary cooling means locally cools the water droplets, it is possible to suppress an increase in energy required for cooling.

(11) The snow making apparatus may further include the snow growth promoting member configured to temporarily capture snow produced in the cylindrical body and allow the captured snow to grow. With such a configuration, since snow grown by the snow growth promoting member can be supplied to the test piece and the test chamber, snow made of larger snowflakes can be supplied.

(12) The snow making apparatus may further include the vibrator configured to vibrate the snow growth promoting member so that the snow captured by the snow growth promoting member falls. With such a configuration, snow can be separated from the snow growth promoting member by vibrating the snow growth promoting member with the vibrator. Therefore, it is possible to prevent snow from being excessively deposited on the snow growth promoting member.

(13) The exemplary embodiment is the environment forming apparatus including the snow making apparatus.

As described above, a running cost can be suppressed.

This application is based on Japanese Patent Applications No. 2020-158577 filed on Sep. 23, 2020 and No. 2021-129625 filed on August 6, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A snow making apparatus comprising:

a test chamber in which a test piece is placed;

a snow making chamber positioned outside the test chamber;

an air conditioner configured to provide a temperature environment in the snow making chamber, the temperature environment having a temperature suitable for producing snow from water droplets;

a cylindrical body; and a snow making nozzle configured to jet water droplets into the cylindrical body, wherein the cylindrical body has a proximal end and a distal end, the proximal end is positioned in the snow making chamber and is opened in the snow making chamber, the snow making nozzle is disposed at a position corresponding to or adjacent to the proximal end positioned in the snow making chamber, a temperature environment in the cylindrical body is same as the temperature environment in the snow making chamber, the water droplets jetted from the snow making nozzle turn into snow during flowing in the cylindrical body from the proximal end toward the distal end, the distal end of the cylindrical body is opened so that air from the snow making chamber and the snow flow out toward the test piece or the test chamber, or is connected to a pipe member which opens so that the air from the snow making chamber and the snow flow out toward the test piece, or is connected to a pipe member which is connected to the test chamber, and the snow making apparatus is configured to maximize the amount of the snow within the cylindrical body that moves continuously through the cylindrical body until flowing out through the distal end of the cylindrical body.

2. The snow making apparatus according to claim 1, wherein the snow making nozzle is formed of a two-fluid nozzle.

3. The snow making apparatus according to claim 1, wherein the distal end of the cylindrical body or the pipe member is connected to a snowfall hood which has a supply opening through which snow is allowed to fall and is disposed in the test chamber, and the cylindrical body is disposed such that the snow in the cylindrical body flows toward the snowfall hood from an upper side to a lower side.

4. The snow making apparatus according to claim 1, further comprising a blower configured to suction the air flowing out from the distal end of the cylindrical body or the pipe member, and blows off the air toward the test piece or the test chamber.

5. The snow making apparatus according to claim 1, wherein the cylindrical body is disposed in an oblique posture so as to descend from the proximal end toward the distal end.

6. The snow making apparatus according to claim 1, further comprising a snow sticking suppressing unit for suppressing the snow from sticking to an inner surface of the cylindrical body.

7. The snow making apparatus according to claim 6, wherein the snow sticking suppressing unit includes a blower that allows air to flow along the inner surface of the cylindrical body.

8. The snow making apparatus according to claim 6, wherein the snow sticking suppressing unit includes an instrument which applies vibration to the cylindrical body.

9. The snow making apparatus according to claim 1, further comprising a snow quality adjustment nozzle for moistening the snow produced in the cylindrical body.

10. The snow making apparatus according to claim 1, further comprising an auxiliary cooling unit configured to blow air toward water droplets jetted from the snow making nozzle, the air having a temperature lower than a temperature in a temperature environment where the proximal end of the cylindrical body is opened.

11. The snow making apparatus according to claim 1, further comprising a snow growth promoting member configured to temporarily capture snow produced in the cylindrical body and allow the captured snow to grow.

12. The snow making apparatus according to claim 11, further comprising a vibrator configured to vibrate the snow growth promoting member so that the snow captured by the snow growth promoting member falls.

13. An environment forming apparatus comprising the snow making apparatus according to claim 1.

14. A snow making apparatus comprising:

a test chamber in which a test piece is placed, an air conditioner configured to provide a temperature environment in the test chamber, the temperature environment having a temperature suitable for producing snow from water droplets, a cylindrical body; and a snow making nozzle configured to jet water droplets into the cylindrical body, wherein the cylindrical body has a proximal end and a distal end, the proximal end is positioned in the test chamber and is opened in the test chamber so as to flow air from the test chamber into the cylindrical body, the snow making nozzle is disposed at a position corresponding to or adjacent to the proximal end positioned in the test chamber, a temperature environment in the cylindrical body is same as the temperature environment in the test chamber, the water droplets jetted from the snow making nozzle turn into snow during flowing in the cylindrical body from the proximal end toward the distal end, the distal end of the cylindrical body is opened in the test chamber so that the air and the snow flow out toward the test piece or inside the test chamber, and the snow making apparatus is configured to maximize the amount of the snow within the cylindrical body that moves continuously through the cylindrical body until flowing out through the distal end of the cylindrical body.

15. The snow making apparatus according to claim 14, further comprising:

a blower disposed outside the cylindrical body; and a blowout pipe connected to the blower and penetrating the cylindrical body, the blowout pipe having an outflow end allowing air to flow out from the blower along an inner surface of the cylindrical body.

16. The snow making apparatus according to claim 1, wherein an inner surface of the cylindrical body has a fluororesin coating applied thereon.

17. The snow making apparatus according to claim 14, wherein an inner surface of the cylindrical body has a fluororesin coating applied thereon.

* * * * *